United States Patent [19]

Butler et al.

[11] Patent Number: 4,712,046

[45] Date of Patent: Dec. 8, 1987

[54] QUADRATURE-COUPLED MICROWAVE ELECTRODELESS LAMP

[75] Inventors: Scott J. Butler, Rochdale; Robert K. Smith, Woburn; Mehdy Abdollahian, Easton, all of Mass.

[73] Assignee: GTE Laboratories Incorporated, Waltham, Mass.

[21] Appl. No.: 930,487

[22] Filed: Nov. 14, 1986

[51] Int. Cl.[4] ..... H05B 41/16; H05B 41/24

[52] U.S. Cl. ..... 315/248; 315/39; 315/344; 313/493; 333/117; 333/121

[58] Field of Search ..... 333/120, 121, 122, 117; 315/248, 39, 344; 313/493

[56] References Cited

U.S. PATENT DOCUMENTS

| | | | |
|---|---|---|---|
| 2,698,381 | 12/1954 | Harvie | 333/120 X |
| 2,925,522 | 2/1960 | Kelliher | 333/121 X |
| 2,935,702 | 5/1960 | Dwork | 333/121 |
| 3,157,823 | 11/1964 | Clapp | 315/248 X |
| 3,375,471 | 3/1968 | Saad | 333/121 |
| 4,178,534 | 12/1979 | McNeill et al. | 315/248 |
| 4,253,047 | 2/1981 | Walker et al. | 315/248 |
| 4,266,162 | 5/1981 | McNeill et al. | 315/248 |
| 4,288,762 | 9/1981 | Laughlin | 333/121 |

*Primary Examiner*—Saxfield Chatmon
*Attorney, Agent, or Firm*—Fred Fisher

[57] ABSTRACT

A re-entrant, low-pressure, electrodeless lamp apparatus includes two identical re-entrant center conductors driven in quadrature, resulting in a matched lamp input impedance in both the off and on states nearly independent of incident microwave power.

9 Claims, 5 Drawing Figures

QUADRATURE-COUPLED MICROWAVE ELECTRODELESS LAMP

BACKGROUND OF THE INVENTION

1. Field of the Invention

This invention relates to electrodeless lamp apparatus and, in particular, to quadrature-coupled microwave electrodeless lamps. Accordingly, it is a general object of this invention to provide new and improved apparatus and lamps of such character.

2. General Background

Various electrodeless lamps have been described in the prior art. For example, U.S. Pat. No. 4,070,603, issued Jan. 24, 1978 to Regan et al., discloses an apparatus in which the light source is of the type including a microwave power source and an electrodeless lamp having a light transmitting envelope and a volatile fill material which emits light upon breakdown and excitation. The outer conductor is a metallic mesh.

U.S. Pat. No. 4,178,534 to McNeill et al., issued Dec. 11, 1979, mentions that electrodeless lamps have the potential for extremely long life, because there is no need for the arc discharge to be in contact with any material either electrodes (i.e. since there are none) or the lamp envelope.

Conventional prior art low pressure, compact, fluorescent, microwave electrodeless lamps present an infinite voltage standing wave ratio (VSWR) to its microwave power source prior to starting. Under this condition, the microwave power source (typically a solid state device which provides drive power to the lamp) is subjected to operating extremes (current, and/or voltage, and temperature) which degrade the device performance, leading to premature failure.

SUMMARY OF THE INVENTION

Another object of this invention is to provide for a new and improved microwave electrodeless lamp apparatus in which the voltage standing wave ratio (VSWR) of the lamp, when in the off state, is substantially reduced compared to lamps of the prior art.

Still another object of this invention is to provide for a new and improved microwave electrodeless lamp apparatus including a power source having a substantially improved lifetime.

Yet another object of this invention is to provide a new and improved microwave electrodeless lamp apparatus in which the input impedance of the apparatus is essentially independent of drive power.

In accordance with one aspect of this invention, an electrodeless lamp apparatus adapted to operate at a microwave frequency f, having a wavelength $\lambda$ which is proportional to the free space wavelength $\lambda_0$, includes a pair of conductors. Each conductor has a pair of ends, one of the conductors having a length $L_1$, the other conductor having a length $L_2$. An electrodeless lamp has an envelope made of light transmitting substance and a volatile fill material enclosed within the envelope. The fill material emits light upon breakdown and excitation. The envelope has a pair of recesses for receiving the conductors therewithin. A conductive mesh encloses substantial portions of the electrodeless lamp. Means are provided for coupling the conductive mesh to a point of reference potential. Means are provided for applying a first voltage at the wavelength $\lambda$ to the second end of the first conductor; and means are provided for applying a second voltage at the wavelength $\lambda$, to the second end of the second conductor. Thus, the two voltages are displaced from each other by 90°. In accordance with certain features of the invention, $L_1$ is equal to $L_2$, and each is equal to $\lambda/4$.

In accordance with another aspect of the invention, the electrodeless lamp apparatus is adapted to operate at a microwave frequency f, having a wavelength $\lambda$ which is proportional to the free space wavelength $\lambda_0$. The electrodeless lamp apparatus includes a first conductor having a first end and a second end. The first conductor has a length $L_1$. Similarly, a second conductor has a first end and a second end, the second conductor having a length $L_2$. An electrodeless lamp has an envelope made of light transmitting substance and a volatile fill material enclosed within the envelope. The fill material emits light upon breakdown and excitation. The envelope has a pair of recesses for receiving the first ends of the conductors therewithin. A conductive mesh encloses substantial portions of the electrodeless lamp. Means are provided for coupling the conductive mesh to a point of reference potential. A load resistor, having one end, has a second end adapted to be coupled to a point of reference potential. The apparatus further includes quadrature hybrid coupler means which has an input port for receiving an input signal $Ae^{-j(\omega t)}$, an isolated port for coupling to the first end of the load resistor, a first output port for providing a signal $$\frac{A}{\sqrt{2}} e^{-j(\omega t+\phi)}$$

to the second end of the first conductor, and a second output port for providing a signal $$\frac{A}{\sqrt{2}} e^{-j(\omega t+\phi+\pi/2)}$$

to the second end of the second conductor. In accordance with certain features of the invention, $L_1$ can be equal to $L_2$, and each can be equal to $\lambda/4$. Each of the recesses can receive a substantial portion of an exclusive one of the conductors. The apparatus can further include a base member means for supporting the electrodeless lamp, coupling the conductive mesh to a point of reference potential, enclosing the quadrature hybrid coupler therewithin, and integrally containing the various components of the compact unit.

BRIEF DESCRIPTION OF THE DRAWINGS

Other objects, advantages, and features of this invention, together with its construction and mode of operation, will become more apparent from the following description, when read in conjunction with the accompanying drawings, in which.

DESCRIPTION OF PREFERRED EMBODIMENTS

Figure 1A:
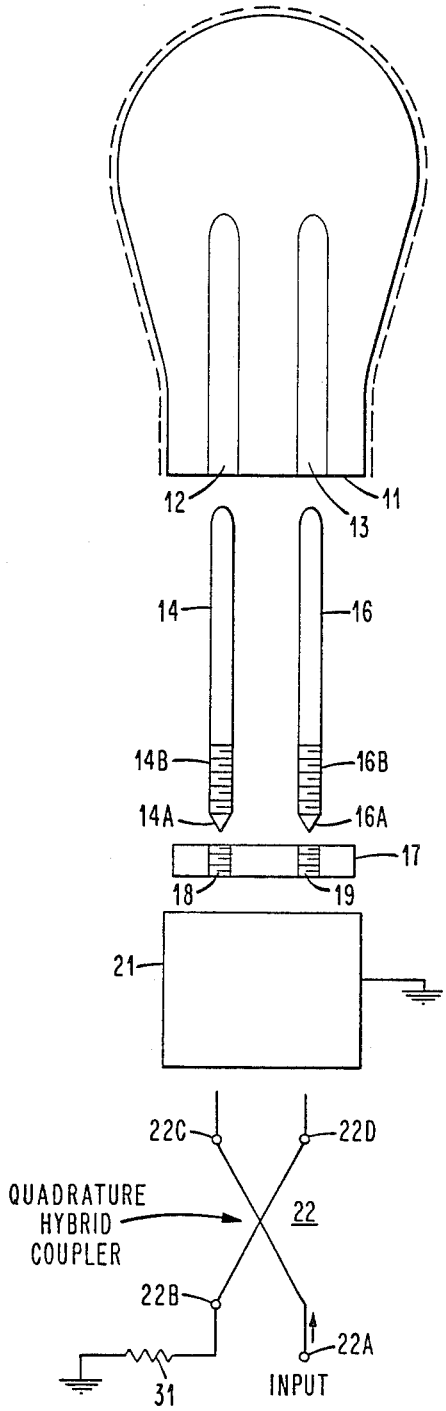
FIG. 1A is an exploded view of a quadrature coupled microwave electrodeless lamp apparatus in accordance with one embodiment of the invention.

Referring to FIG. 1A, there is shown an electrodeless lamp 11. The electrodeless lamp 11 includes an envelope of a light transmitting substance that completely encloses a volatile fill material enclosed within the envelope, the fill material emitting light upon breakdown and excitation. The electrodeless lamp 11 . further has a pair of recesses 12, 13 formed therein. The recesses 12, 13 do not physically contact the fill material within the electrodeless lamp 11.

A pair of conductors 14, 16, which can be constructed of copper, may have a length (by way of example) of 3½ inches, tapered at ¼ of an inch from one end 14A, 16A, and threaded for about ½ inch at an area 14B, 16B, near those ends. A rod holder 17, constructed of insulating material such as plexiglass, has a pair of threaded orifices 18, 19 that receive the threaded rods 14, 16. By way of illustration and not by limitation, the centers of the orifices 18, 19 can be displaced from each other a distance of 0.64 inch.

The rod holder 17 supporting the rods 14, 16 can be housed within a base 21 formed of conductive material such as aluminum.

A hybrid quadrature coupler 22 has an input port 22A, an isolation port 22B, a first output 22C, and a second output 22D.

The invention as described herein utilizes the quadrature hybrid coupler 22 and two center conductors 14, 16 in order to route the reflected power $P_r$ into a dummy load 31 which is coupled to a point of reference potential. This invention results in an input impedance which is well matched prior to starting, thereby improving the life of the power source (not shown). In addition, unlike conventional electrodeless lamps, the input impedance is essentially independent of drive power; thus, fluctuations in radio frequency power due to prime power variations have less effect upon power source frequency and power stability.

Figure 1B:
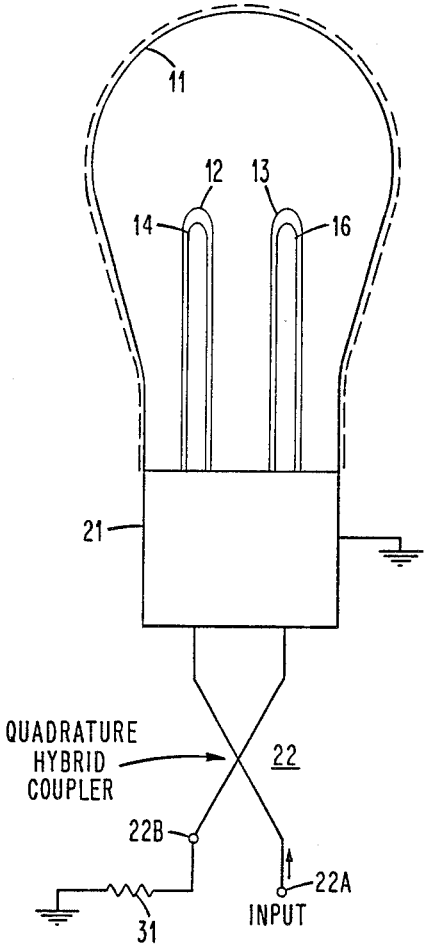
FIG. 1B is a schematic illustration of an assembled quadrature coupled microwave electrodeless lamp apparatus in accordance with an embodiment of the invention.
Figure 1C:
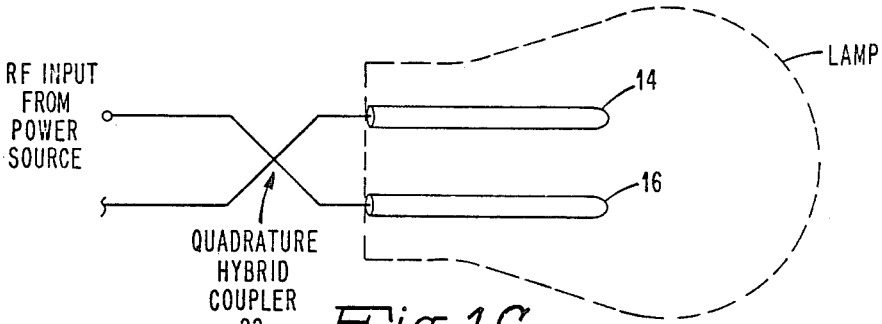
FIG. 1C is a diagrammatic view of a quadrature coupled microwave electrodeless lamp apparatus in accordance with an embodiment of the invention.

A schematic illustration of the invention is depicted in FIG. 1B. In the off state, since the length of each center conductor 14, 16 is approximately $\lambda/4$ at the operating frequency (which can lie in a band from 902 to 927 MHz, preferably about 915 MHz) there is little or no coupling between them 14, 16. Therefore, the input power, $P_f$, is divided by the quadrature hybrid 22, and the conductors 14, 16 are driven by signals of equal amplitude in quadrature (90° out of phase). The power incident to each center conductor is totally reflected, resulting in the reflected power being directed to the isolation port 22B of the coupler 22, where the power is dissipated in the load resistor 31.

Similarly, in the on state, each conductor 14, 16 is again driven 90° out of phase. However, most of the incident power is absorbed by the discharge. Reflected power from the discharge is again dissipated in the load 31. The finite coupling between the conductors 14, 16 results in directing a small portion of the incident power back into the input port 22A. This power appears as a "reflected" wave at the input of the coupler 22, the magnitude of which is determined by the complex permittivity of the discharge and the even- and odd-mode impedances of the coupled center conductors 14, 16. Geometrical features can be adjusted to minimize this "reflected" wave at the frequency of operation. In addition, the even- and odd-mode impedance of the center conductors 14, 16 can be adjusted, so that any length of center conductor should result in a well-matched input impedance in both the on and off states.

The electrodeless lamp 11, as stated above, can be made of a light transmitting material. The material can be glass, quartz, and the like. Depending on the various conditions such as the fill, the pressure, the frequency, etc., different types of light may be emitted. Under certain conditions, visible light can be used with no other modification. In instances where the excitation of the fill generates ultraviolet energy, the inside surface of the lamp 11 can be coated with a phosphor which would emit visible light upon excitation by ultraviolet, as is well-known in the fluorescent light field.

Quadrature hybrid coupler can be a coupler commercially available such as those provided by Anaren Microwave, Inc., E. Syracuse, N.Y., such as those sold under Model No. 1B0264-3, having a range from ½ to 1 GHz. The coupler can be operated 3 Db, 90°. Alternatively, a hybrid coupler can be provided from material sold as "wireline" from Sage.

The construction of an electrodeless lamp as indicated earlier, using the 3½ inch rod, for example, for the conductors 14, 16, were calculated for 900 MHz operation.

The return loss of the lamp can be measured using the network analyzer system at the off condition between 800 MHz and 1 GHz.

It was noted, in the course of measurement, that the highest return loss occurred at 800 MHz although the measurements were based on 900 MHz calculation. It is believed that that was due to fringing capacitance existing between the center conductors and the different dielectrics (air, plexiglass, plasma).

Figure 2:
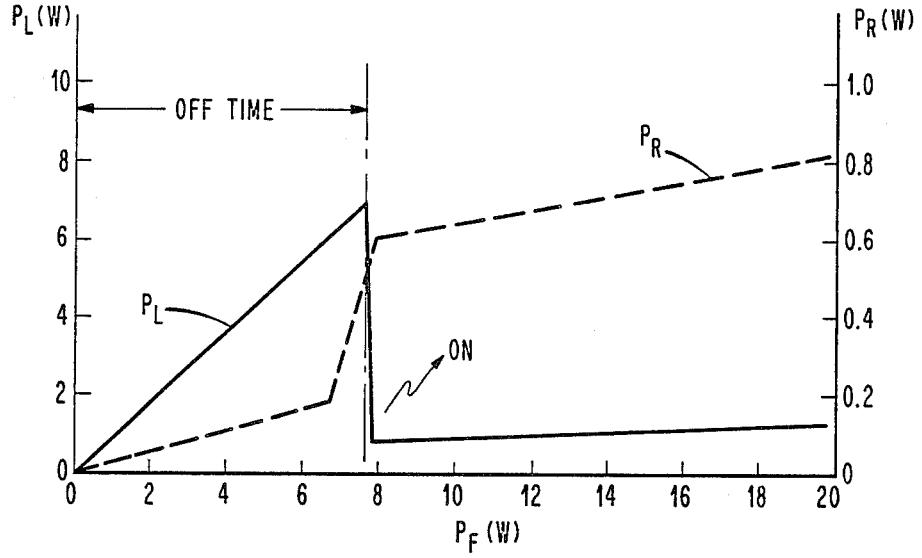
FIG. 2 is a diagram showing the relationship of forward power $P_f$, reflected power $P_r$, and power dissipated in the load $P_L$. The solid line depicted in the chart in FIG. 2 represents the power dissipated in load $P_L$, whereas the dashed line shown therein represents the reflected power $P_r$.

The lamp was then tested at 800 MHz, providing results as depicted in FIG. 2.

Referring to FIG. 2, note that as the forward power is increased, the reflected power increases slightly, so that though the forward power is at 6 watts, the reflected power is less than 0.2 watt. The power dissipated in the load is less than 6 watts. In contrast, it is noted that in the absence of this invention (that is, in the absence of a 90° circuit), the reflected power would be equal to the forward power, and, hence, the driving transistors for the power source and their associated circuitry would be subject to damage.

Figure 3:
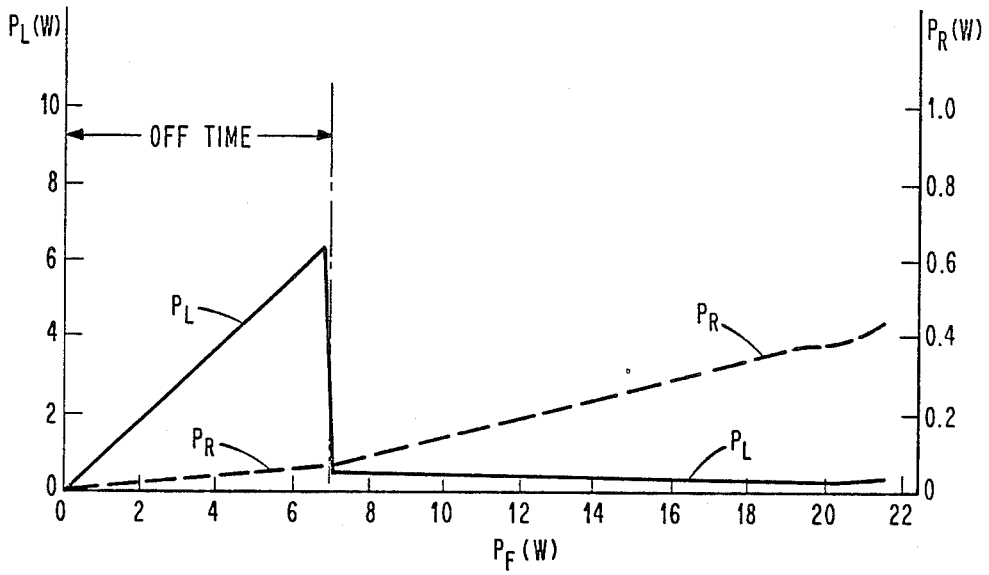
FIG. 3 is a diagram showing the relationships of $P_f$, $P_L$, and $P_r$, utilizing more effective grounding and shielding.

With the addition of more effective grounding and shielding of the lamp, reduced, reflected power can be achieved and reduced loss of power dissipated in the load $P_l$ can also be achieved as depicted in FIG. 3.

Various modifications will suggest themselves to those skilled in the art without departing from the spirit and scope of this invention.

What is claimed is:

1. Electrodeless lamp apparatus adapted to operate at a microwave frequency f, having a wavelength $\lambda$ which is proportional to the free space wavelength $\lambda_0$, said electrodeless lamp apparatus comprising (a) a first conductor having a first end and a second end, said first conductor having a length $L_1$;

(b) a second conductor having a first end and a second end, said second conductor having a length $L_2$;

(c) an electrodeless lamp having an envelope made of light transmitting substance and a volatile fill material enclosed within said envelope, the fill material emitting light upon breakdown and excitation, said envelope having a pair of recesses for receiving the first ends of said conductors therewithin;

(d) a conductive mesh enclosing substantial portions of said electrodeless lamp;

(e) means for coupling said conductive mesh to a point of reference potential;

(f) means for applying a first voltage, at said wavelength $\lambda$, to the second end of said first conductor; and (g) means for applying a second voltage, at said wavelength $\lambda$, to the second end of said second conductor, whereby said first voltage and said second voltage are displaced from each other by ninety degrees.

2. The apparatus as recited in claim 1 wherein $L_1$ is equal to $L_2$.

3. The apparatus as recited in claim 2 wherein $L_1$ is equal to $L_2$ and each is equal to $\lambda/4$.

4. The apparatus as recited in claim 3 wherein each of said recesses receives a substantial portion of an exclusive one of said conductors.

5. Electrodeless lamp apparatus adapted to operate at a microwave frequency f, having a wavelength $\lambda$ which is proportional to the free space wavelength $\lambda_0$, said electrodeless lamp apparatus comprising (a) a first conductor having a first end and a second end, said first conductor having a length $L_1$;

(b) a second conductor having a first end and a second end, said second conductor having a length $L_2$;

(c) an electrodeless lamp having an envelope made of light transmitting substance and a volatile fill material enclosed within said envelope, the fill material emitting light upon breakdown and excitation, said envelope having a pair of recesses for receiving the first ends of said conductors therewithin;

(d) a conductive mesh enclosing substantial portions of said electrodeless lamp;

(e) means for coupling said conductive mesh to a point of reference potential;

(f) a load resistor having a first end, and a second end adapted to be coupled to a point of reference potential; and (g) quadrature hybrid coupler means having an input port for receiving an input signal $Ae^{-j(\omega t)}$, an isolated port for coupling to said first end of said load resistor, a first output port for providing a signal $$\frac{A}{\sqrt{2}} e^{-j(\omega t+\phi)}$$

to the second end of said first conductor, and a second output port for providing a signal $$\frac{A}{\sqrt{2}} e^{-j(\omega t+\phi+\pi/2)}$$

to the second end of said second conductor.

6. The apparatus as recited in claim 4 wherein $L_1$ is equal to $L_2$.

7. The apparatus as recited in claim 6 wherein $L_1$ is equal to $L_2$ and each is equal to $\lambda/4$.

8. The apparatus as recited in claim 7 wherein each of said recesses receives a substantial portion of an exclusive one of said conductors.

9. The apparatus as recited in claim 5 further comprising a base member means for supporting said electrodeless lamp, coupling said conductive mesh to a point of reference potential, enclosing said quadrature hybrid coupler therewithin, and integrally containing the various components as a compact unit.

* * * * *